FIP7811 OR 4,113,315

United States Patent [19]

Melton, Jr. et al.

[11] 4,113,315

[45] Sep. 12, 1978

[54] COMBUSTION APPARATUS FOR GENERATING REPETITIVE EXPLOSIONS

[75] Inventors: Rosser B. Melton, Jr., Helotes; John W. Colburn, Jr.; Charles D. Wood, III, both of San Antonio, all of Tex.

[73] Assignee: Southwest Research Institute, San Antonio, Tex.

[21] Appl. No.: 515,310

[22] Filed: Oct. 16, 1974

Related U.S. Application Data

[62] Division of Ser. No. 427,040, Dec. 21, 1973, Pat. No. 3,880,568.

[51] Int. Cl.[2] ..... E21C 29/00

[52] U.S. Cl. ..... 299/13; 299/14; 299/37

[58] Field of Search ..... 299/14, 37, 13; 37/1, 37/18; 172/699; 431/1

[56] References Cited

U.S. PATENT DOCUMENTS

| | | | |
|---|---|---|---|
| 3,574,404 | 4/1971 | Hogan | 299/37 |
| 3,600,116 | 8/1971 | Clark, Jr. et al. | 431/1 |
| 3,619,917 | 11/1971 | Fischer | 299/37 X |
| 3,713,496 | 1/1973 | Codlin | 37/1 |

*Primary Examiner*—Ernest R. Purser
*Assistant Examiner*—William F. Pate, III
*Attorney, Agent, or Firm*—Hubbard, Thurman, Turner, Tucker & Glaser

[57] ABSTRACT

Staged combustion apparatus is disclosed for generating repetitive explosions. The apparatus includes a first chamber in which a gas under pressure is ignited by an ignition source, such as a spark plug, and a second chamber in which gas under pressure is ignited by gas discharging from the first chamber. The second chamber includes a discharge outlet and a dump valve is provided responsive to the gas pressures in the two chambers for permitting the discharge of gas under pressure from the second chamber when it is ignited. The gas discharge, for example, may be conducted about the tooth of a ripper plow to aid in earth fracture.

5 Claims, 9 Drawing Figures

FIG. 6
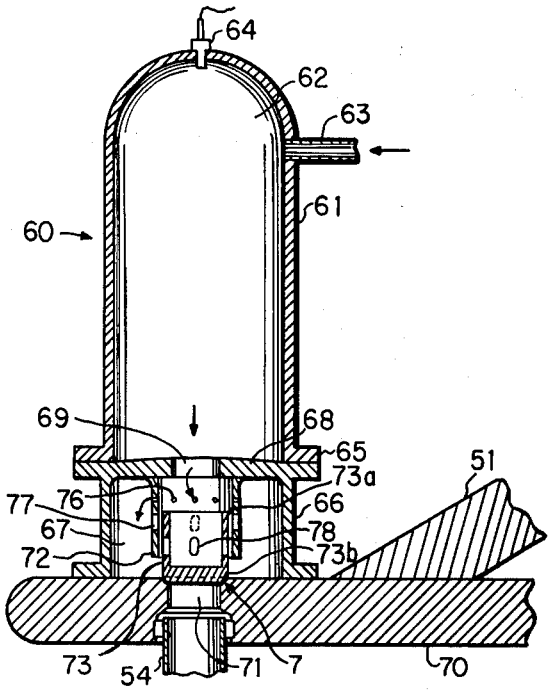
FIG. 9
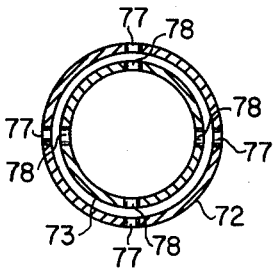
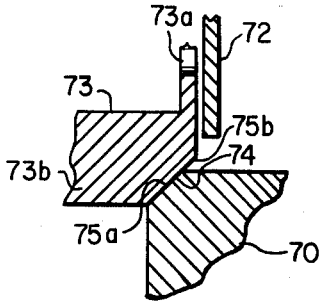
FIG. 7
FIG. 8
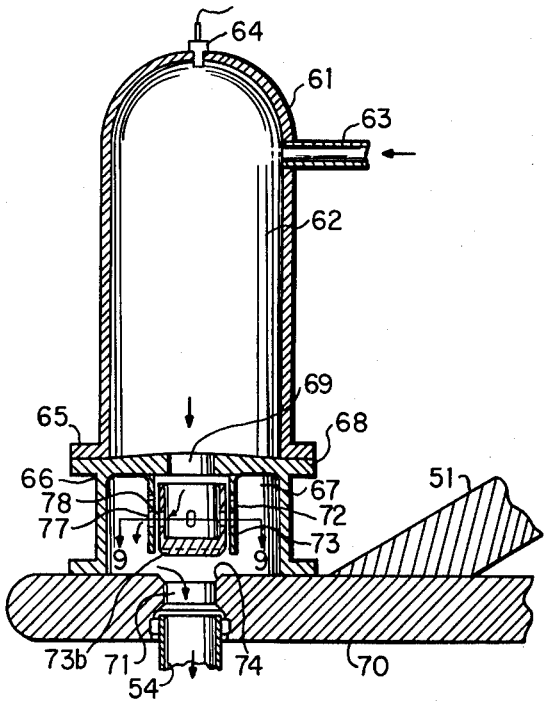

COMBUSTION APPARATUS FOR GENERATING REPETITIVE EXPLOSIONS

This is a division of application Ser. No. 427,040, filed Dec. 21, 1973 now U.S. Pat. No. 3,880,568.

This invention relates to combustion apparatus for generating repetitive explosions for useful work, and in one of its aspects to such apparatus for use with a tractor drawn earth ripper.

U.S. Pat. No. 3,461,577 shows a method and apparatus for repetitively displacing material by exploding a hydrocarbon fuel in a closed combustion chamber and directing the high pressure exhaust gas against the material to fragment and displace the material. The combustion chamber is provided with carburetion means for charging a fuel mixture under pressure into the combustion chamber. Combustion is initiated in the mixture by a suitable ignitor such as a spark or glow plug. An exhaust valve is provided for sealing the combustion chamber until a predetermined pressure is reached in the chamber subsequent to combustion. Thereafter, the exhaust valve opens so that the high pressure and temperature gases and combustion products are rapidly released and directed to fragment the soil.

In addition to the use of the combustion gases for fragmenting and dislodging soil and rock, other applications of this general type of device are also found in the prior art. For example, U.S. Pat. No. 3,572,273, shows the use of the repetitive combustion principle applied to the breaking and melting of ice. This principle may also be applied in conjunction with propulsion devices and for the production of seismic shock waves.

In co-pending patent application Ser. No. 365,629, entitled "Sleeve Valve", filed May 31, 1973, a single combustion chamber apparatus employing an exhaust valve is disclosed which can be effeciently and rapidly operated to release pressure in repetitive explosion devices of the type described above. The valve comprises a generally cylindrical valve body having one or more ports in it, and a cylindrical valve sleeve is reciprocable along the interior surface of the valve body and seats on a bottom cover plate defining an annular pressure chamber with the seat. The valve sleeve is responsive to combustion in the valve body to open up exhaust ports and release high pressure combustion gases from an outlet in the body. This valve has proven to be particularly effective in repetitive explosion devices requiring relatively large combustion volumes such as that shown in U.S. Pat. Nos. 3,461,557 and 3,572,273.

Further, the type of single chamber combustion apparatus described is also useful in conjunction with a tractor drawn ripper such as illustrated in co-pending patent application entitled "Earth Ripper Employing Repetitive Explosions" and filed concurrently with this application. However, its usage requires relatively high charging pressures and a relatively large air compressor for providing these pressures must be made accessible to the ripper tractor. This requirement limits the usage of that apparatus since the compressor apparatus may be so large that it impedes field operations and a separate tractor may have to be provided to pull it.

The present invention provides apparatus for generating repetitive explosions without the need for a relatively large compressor for providing the initial charging pressures, and by the use of a relatively simple valve structure that is positively held on its seat during ripping operations. Also, the apparatus for providing the required charging pressures can be small enough to mount on the ripper tractor, thus eliminating the need for heavy peripheral equipment and enhancing operations in the field.

While the principles of the present invention are described in the context of providing repetitive explosions for use with a tractor drawn earth ripper, it is to be understood that the present principles may be employed in other devices where repetitive explosions are employed. The advantages of the present invention are provided by apparatus employing staged combustion so that gas in a first chamber is ignited and compresses gas in a second chamber and subsequently ignites it. Thus, while the gas emerging from the second chamber may be under relatively high pressure, the first chamber may be charged from a relatively low pressure source. In order to control the release of gas under pressure from the second chamber, a dump valve is provided therein which responds to the pressure in each of the staged chambers to prevent dumping of the high pressure gas in the second chamber until its pressure is a predetermined pressure greater than the pressure in the first chamber. A reference pressure from the first chamber may be conducted to the dump valve so that during initial charging and prior to ignition of the gas in the second chamber, the dump valve is held closed by pressure from the first chamber and opens in response to the ignition of the gas in the second chamber. The dump valve in this instance may be relatively small and simple and is very responsive to permit rapid firing in the order of every 2 seconds.

As described herein, apparatus employing the staged combustion principle of this invention may be readily adapted to mounting on a tractor drawn rock ripper for the same purpose as the apparatus disclosed in the referenced patent application filed of even date herewith. In this application, since the necessary charging pressures of the system are substantially lower than with use of apparatus employing a single combustion chamber, an air blower can be employed to provide this pressure and it is not necessary to provide a bulky and expensive auxiliary air compressor which may be required to provide higher charging pressures.

DESCRIPTION OF THE DRAWINGS

In the drawings, wherein preferred embodiments of this invention are illustrated, and like reference numerals are used throughout to designate like parts:

FIG. 6 is a sectional, schematic view of another form of apparatus employing the staged combustion principle with the dump valve thereof shown in its position during ignition;

FIG. 7 is an enlarged view at 7 in FIG. 6;

FIG. 8 is a view similar to FIG. 6 but in which the dump valve is shown in its position during high pressure discharge of gas from the apparatus;

FIG. 9 is a sectional view taken at 9—9 in FIG. 8.

Referring now to FIG. 1, a staged combustion apparatus 10 is illustrated as including a first combustion chamber $V_1$ of relatively large volume, a second chamber $V_2$ generally of relatively smaller volume, a connecting orifice 11, between chambers $V_1$ and $V_2$, an ignition source 12, which may be a spark plug or glow plug, and an inlet 13 through which a charging mixture of gas and air may be injected under pressure. A check valve 14 may be provided in inlet 13 and a check valve 15 may be provided in connecting orifice 11. Thus, with this arrangement, which is shown for the purpose of illustrating the principles of the present invention, chambers $V_1$ and $V_2$ are initially charged with an air-gas mixture at a relatively low pressure, for example, 15–20 psig. The gas in chamber $V_1$ is then ignited and as it burns it compresses the unburned gas ahead of the flame front moving down the chamber $V_1$. This increasingly compressed gas flows into chamber $V_2$ through orifice 11. At the time the flame front in $V_1$ reaches orifice 11, the pressure of the unburned gas in $V_1$ is relatively high, i.e., 100 psi. The flame front passes through orifice 11 and ignites the unburned gas in $V_2$, which quickly burns to produce the pressure of 600 psi as a peak final pressure in $V_2$. A check valve 15 prevents a return flow of gas from $V_2$ to $V_1$. This relationship is approximately as shown in FIG. 2 wherein the ratio of final explosion pressures in chamber $V_2$ to the initial charging pressure is illustrated. As shown therein, this ratio may be on the order of 36:1 after ignition in chamber $V_2$, wherein with a single stage of combustion, this ratio is about 6:1. Thus, it is possible to provide the relatively high discharge pressure required for useful work in various applications as illustrated herein by use of a relatively small initial charging pressure. FIGS. 3–9 relate to apparatus employing the staged combustion principle described which are particularly adaptable for use with a tractor-drawn rock ripper to aid in earth fracture. Of course, this apparatus and other apparatus employing the principles of this invention may also be useful in other applications where relatively high pressures and small volumes of gas discharge are useful.

Referring now to FIG. 3, staged combustion apparatus 20 is illustrated as including a first vessel or shell 21 providing a first combustion chamber 21*a* of relatively large volume, and a second vessel or shell 22 providing a second combustion chamber 22*a* of relatively small volume. Chambers 21*a* and 22*a* are connected by an orifice 23 having fluid communication between the chambers, and orifice 23 includes a check valve 24 mounted therein. Shell 21 includes an ignition source 25 extending into chamber 21*a* and an inlet 26 connected through a check valve 27 and a conduit 28 to a fluid source providing an air-gas charging mixture. As illustrated in FIG. 3, this source may include carburetion apparatus 29 connected to a source of compressible and combustible gas (not shown) through a conduit 30 and to a centrifugal blower 31 through a conduit 32. Blower 31 may be driven by a motor 32 which may be, in turn, connected to the electrical system of the tractor on which the apparatus 20 is to be mounted, or the blower may be belt-driven by the tractor engine. Shell 22 also includes a fuel-air mixture inlet 34 connected through a check valve 35 to carburetion apparatus 29 for receipt of a fuel-air fuel mixture therefrom. Shell 22 also includes a discharge opening or outlet 36 in the lower portion thereof, and a dump valve 37 including a valve seat 38 and a valve member 39 is also mounted in the lower portion of chamber 22*a*. An opening is formed in chamber 22*a* between outlet 36 and the upper portion of chamber 22*a* and valve member 39 moves from a position in which this opening is closed to a position in which the opening is open. A conduit 40 may be connected between chamber 21*a* and the lower end of chamber 22*a* to provide a reference pressure to the lower face of valve member 39, and lubrication for valve member 39 may be provided by a conduit 39*a*. Valve member 39 is arranged so that as long as the pressure in chamber 21*a* is equal to or greater than the pressure in the upper portion of chamber 22*a*, by virture of the reference pressure provided by conduit 40, the valve member is closed on seat 38. However, when the pressure in chamber 22*a* acting on the top face of valve member 39 exceeds the pressure from chamber 21*a* acting on the lower face by a predetermined amount, such as occurs when the gas-air mixture in chamber 22*a* is ignited, then valve member 39 is forced off of seat 37 to open up the passageway in chamber 22*a* to outlet 36 and permit the discharge of gas under pressure from chamber 22*a*. Thus, while both chambers are initially charged with an air-gas mixture at a relatively low pressure, i.e., 15–20 psig, when the air-gas mixture in chamber 21*a* is ignited, it discharges through orifice 23 to compress gas in chamber 22*a* until it is ignited at a relatively higher pressure and forces valve 37 open to permit the discharge of exhaust gas from chamber 22*a* through outlet 36. Referring now to FIGS. 4 and 5, apparatus 20 is illustrated as being mounted on the back of a tractor 50 in conjunction with a rock ripper 51 pivotally mounted on the back of a tractor. Ripper 51 may be of any conventional type of ripper and may be similar to that shown in the above referred to pending patent application entitled "Earth Ripper Employing Repetitive Explosions". Ripper 51 includes a ripper shank 52 having a tooth 53 located on its lower end so that the tractor may pull the ripper as a plow for earth fracture. As illustrated and described in the referred to co-pending patent application, an exhaust duct 54 may be mounted on shank 52 to provide for the discharge of exhaust gas from a combustion apparatus to provide repetitive explosions about the lower end of shank 52 and about tooth 53. Reference is made to the co-pending application referred to for details of the mounting of exhaust duct 54 on shank 52 and further details of the mounting of the ripper plow 51 on tractor 50.

As illustrated in FIG. 4, apparatus 20 may be mounted on ripper 51 so that duct 54 connects into the discharge outlet 36 of apparatus 20. Thus, when gas discharges from outlet 20 in the form of repetitive high pressure discharges, the gas will discharge through duct 54 and into the earth adjacent tooth 53 to cause repetitive explosions in the earth and in fractures 55 therein adjacent the tooth. FIG. 4 illustrates the position of valve member 39 during ignition of chamber 21*a* of apparatus 20 and prior to discharge, and the relationship between shank 52 and tooth 53 and the earth being fractured. Because of the reference pressure from chamber 21*a* through conduit 40, valve member 39 is seated on valve seat 38 during this portion of the combustion cycle. FIG. 5 illustrates the position of the valve member 39 after gas under pressure in the second chamber 22*a* is ignited by gas discharging from first chamber 21*a* into chamber 22*a* and when the pressure in chamber 22*a* reaches a value sufficient to open valve 37. During this portion of the combustion cycle, as valve 37 is opened, exhaust gas escapes from chamber 22*a* through outlet 36 to aid in dislodging rock and earth about tooth 53, and about fractures 55 in the earth.

Figure 1:
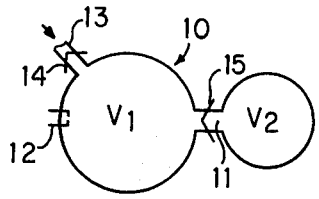
FIG. 1 is a schematic view illustrating the principle of staged combustion employed by the present invention.
Figure 2:
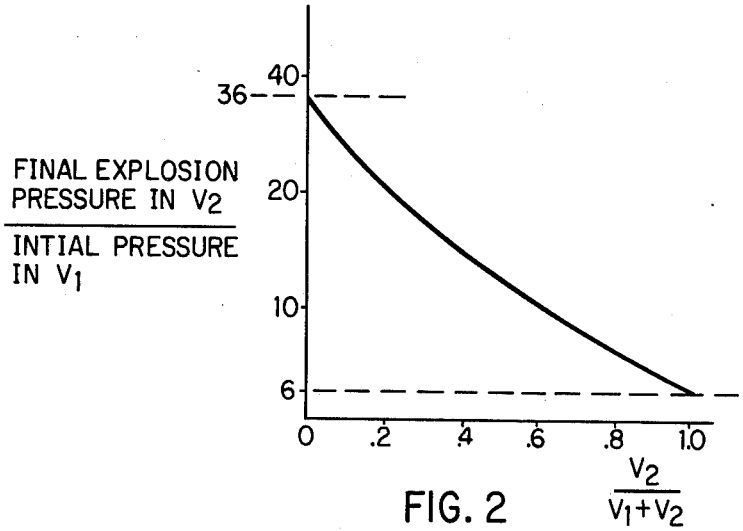
FIG. 2 is a graph illustrating the discharge pressure amplification provided by apparatus such as shown in FIG. 1.
Figure 3:
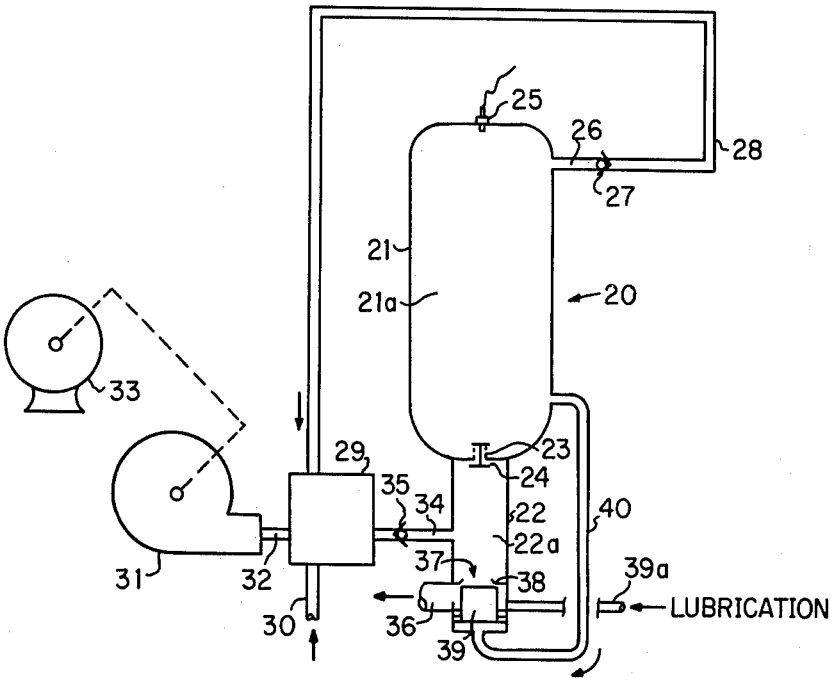
FIG. 3 is a schematic view of one form of apparatus employing the present invention for use with a tractor-drawn ripper.
Figure 4:
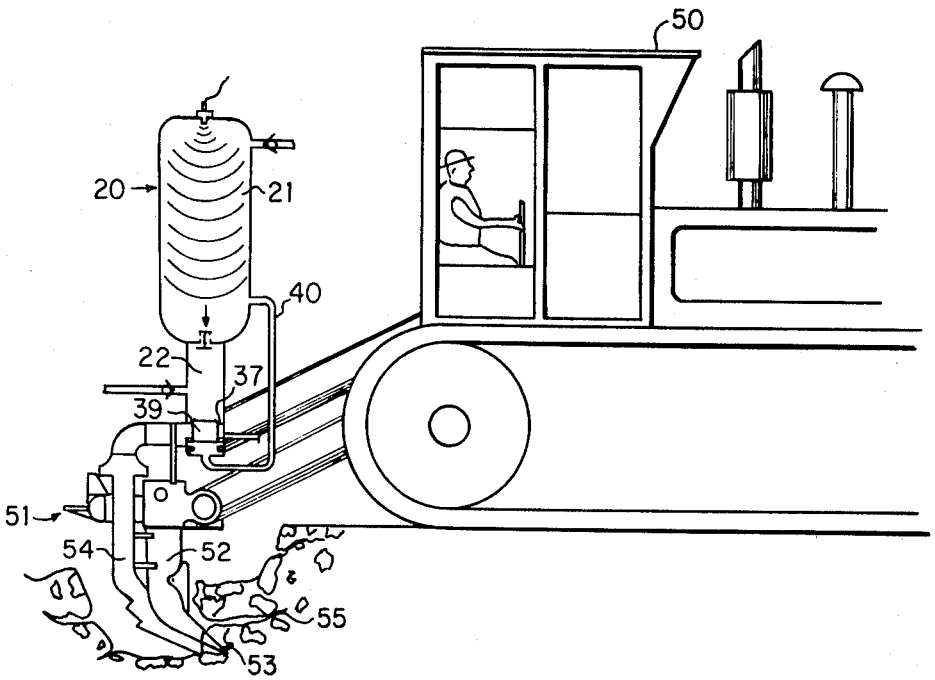
FIG. 4 illustrates the apparatus of FIG. 3 mounted on a ripper with the position of the dump valve shown during ignition.
Figure 5:
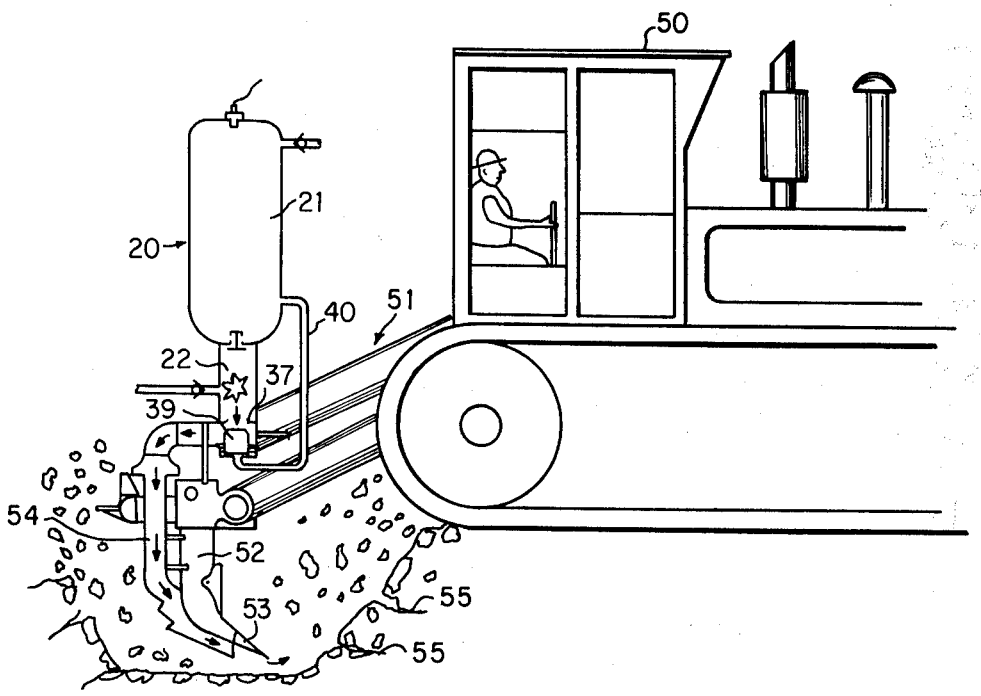
FIG. 5 is a view similar to FIG. 4 with the position of the dump valve shown during discharge of gas from the apparatus.

Referring now to FIGS. 6–9, another form of the staged combustion apparatus of this invention is illustrated for use with a rock ripper apparatus such as illustrated in FIGS. 4 and 5 and described in the co-pending patent application referenced above. In FIG. 6, a staged combustion apparatus 60 is illustrated as including a vessel or shell 61, which may be cylindrical, providing an enclosed first combustion chamber 62. A fuel-air mixture is conducted into chamber 62 through an inlet 63 provided in shell 61 and an ignition source such as a spark plug 64 is mounted in shell 61 so that when activated, it will ignite fuel in chamber 62. Shell 61 is mounted by a suitable flange 65 onto the top of a similar flange on the top of a second shell 66, which also may be cylindrical, enclosing a second chamber 67. The upper wall of second chamber 67 and the lower wall of first chamber 62 are formed by the top plate 68 of shell 66 and an opening 69 is provided between chambers 62 and 67 to provide fluid communication therebetween. Shell 66 may be mounted on a plate 70, including an opening 71 therein over which shell 66 is mounted, and plate 70 may be connected to tractor 50 and rock ripper 51 in a suitable manner to replace apparatus 20 of FIGS. 3 and 4. The manner in which apparatus 60 is mounted on tractor 50 in conjunction with ripper 51 forms no part of the present invention.

Opening 71 forms a discharge outlet for chamber 67, and exhaust conduit 54 of ripper 51 may be connected to outlet 71. A valve means is disposed in the second chamber 67 for movement between a position wherein outlet 71 is closed and restricted fluid flow between chambers 62 and 67 is provided, to a second position wherein communication between chambers 62 and 67 is interrupted and outlet 71 is open to permit exhaustion of gases in chamber 67 through the outlet to exhaust duct 54. A preferred form of such a valve means is illustrated in FIG. 6 as including a cylindrical outer sleeve 72 or valve guide extending down from plate 68 and about opening 69, and an inner movable element 73 mounted in guide 72 for reciprocable movement therein between the respective positions. Element 73 forms a valve member and includes a hollow, cylindrical upper body portion 73*a*, and a lower portion 73*b* adapted to seat about the top edge of opening 71 in member 70, which forms a valve seat 74. It is to be understood that valve member 73 is mounted in guide 72 in a manner so that the annular space between the members is sealed to prevent passage of fluid through this annulus by suitable sealing means (not shown). Also, as illustrated in FIG. 7, the lower end 75*a* of valve member 72 is tapered to seat on valve seat 74, and the relationship between lower edge 75*a* of valve member 73 and seat 74 is such that a portion 75*b* of the edge 75*a* extends from seat 74 into chamber 67 when seated so that this portion may be acted on by the pressure in chamber 67. The upper surface of the lower portion 73*b* of valve member 73 is exposed to the pressure in chamber 62 through opening 69 and this pressure acts to maintain the valve closed except when high pressures are obtained in chamber 67 after ignition of the gas therein.

Valve guide 72 includes a plurality of charging portion 76 through which gas from chamber 62 can pass into chamber 67. Ports 76 are equally spaced about the periphery of guide 72 so that when valve member 73 is closed, flow through these ports will be unobstructed. Valve guide 72 also includes a plurality of larger scavenge ports 77 located below ports 72, and valve member 73 includes a like number of scavenge ports 78 vertically in line with ports 77 as shown in FIG. 8, but located in the upper body portion 73*a* of valve member 73 so that they are below scavenge ports 77 when the valve means is closed. For example, four ports 77 may be equally spaced about the periphery of guide 72, and four ports 78 about the periphery of body portion 73*a*. Also, as shown in FIG. 7, when valve member 73 is fully open, ports 77 and 78 are in horizontal alignment to permit the flushing out of burned gas from chambers 62 and 67 and replacement with fresh fuel-air mixture for the next firing cycle. The upper body portion 73*a* of valve member 73 extends into guide 72 a sufficient distance so that when the valve is partially opened upper body portion 73*a* of the valve member closes ports 76, prior to complete alignment of ports 77 and 78, and ports 76 remain closed by the valve member body when it is fully open. Means (not shown) such as ribs and grooves may be provided to support and guide valve member 73 in guide 72, and prevent rotation of the valve member as is conventional in such a structure.

In operation of the apparatus of FIGS. 6–9, compressed air and fuel are admitted into the first stage combustion chamber 62 through inlet 63, and the mixture also passes into the second stage combustion chamber 67 through ports 76. After charging of the combustion chambers, ignition is initiated through source 64 in chamber 62 and the flame front from this ignition then arrives at ports 76. Since a plurality of these ports are provided, a high degree of turbulence is induced in second stage chamber 67 ensuring good mixture and combustion as the flame front passes through ports 76. As a result of the increased pressure of combustion in chamber 67 acting on the lower face of valve member 73, which rises to a value higher than the pressure forcing valve member 73 closed, valve member 73 is forced off its seat 74 to open passageway 71 out of combustion chamber 67. The upward travel of valve member 73 closes ignition ports 76 and allows the combustion gases in second stage combustion chamber 67 to discharge through outlet 71 and into discharge duct 54. As the valve member 73 continues upwardly, scavenge ports 77 and 78 come into alignment to permit blowdown of the first state combustion chamber 62 to prepare it for the next charging and ignition cycle. As chamber 62 is recharged, valve member 73 is then forced back by the change in pressure differential to its closed position to permit the buildup of pressure in chambers 62 and 67 for a subsequent ignition and combustion cycle.

Of course, the dump valve in each of the embodiments described can take many different forms which permit it to be responsive to the pressures in the first and second stage chambers to provide its required function. Since the valve member in each of the embodiments described is held in position by a positive pressure from the first stage combustion chamber during charging and ignition and prior to final discharge, it will not bounce off its seat due to high acceleration loads encountered during normal operations of the ripper plow. Also, since the valve member may be relatively small compared to the overall size of the apparatus, it can respond rapidly to changes in pressure in the two chambers of the staged combustion apparatus.

From the foregoing, it will be seen that this invention is one well adapted to attain all of the ends and objects hereinabove set forth, together with other advantages which are obvious and which are inherent to apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. Apparatus employing repetitive explosions for earth fracture, comprising, in combination:

a tractor;

ripper means mounted on said tractor and adapted to penetrate the earth;

staged combustion apparatus for generating repetitive explosions in the earth adjacent said ripper means, said staged combustion apparatus comprising a first chamber including an inlet in said chamber adapted to be connected to a source of combustible fluid, ignition means mounted in said first chamber for igniting fluid therein, a second chamber adjacent said first chamber and including an outlet for repetitive discharge of ignited fluid under pressure, means providing for fluid communication from said first chamber to said second chamber, and valve means disposed in said second chamber for preventing the passage of fluid under pressure from said second chamber into said outlet except when the pressure in said second chamber exceeds the pressure in said first chamber by a predetermined amount; and duct means connected to said outlet for conducting gas under pressure externally of said ripper means from said outlet for discharge into the earth adjacent an end of said ripper means.

2. The apparatus of claim 1 wherein said means providing for fluid communication between said chambers is a flow orifice having a check valve disposed therein, and said valve means is a dump valve responsive to fluid pressure in said first and second chambers.

3. The apparatus of claim 2 further including conduit means connected to conduct fluid under pressure in said first chamber to said dump valve.

4. The apparatus of claim 1 wherein said first and second chambers are formed with a wall therebetween having an opening therethrough and said valve means includes a valve guide extending about and from said opening into said second chamber, said valve guide including a plurality of ports communicating between the interior of said guide and said second chamber, and a valve member slidable in said guide from a position wherein said outlet is closed and said ports are open, to a position wherein said outlet is open and said ports are closed.

5. The apparatus of claim 4 further including scavenge ports in said valve guide and in said valve member disposed so that when said dump valve is fully opened, scavenge ports in said valve guide are in substantial alignment with scavenge ports in said valve member.

* * * * *

UNITED STATES PATENT OFFICE

CERTIFICATE OF CORRECTION

Patent No. 4,113,315 Dated September 12, 1978

Inventor(s) Rosser B. Melton, Jr.; John W. Colburn, Jr.; Charles D. Wood, III

It is certified that error appears in the above-identified patent and that said Letters Patent are hereby corrected as shown below:

Column 3, line 38, "FIGS 3 - 9" should start a new paragraph.

Column 3, line 52, "having" should be —providing—.

Column 4, line 32, "Referring" should start a new paragraph.

Column 5, lines 66-67, "portion" should be —ports—.

Signed and Sealed this

*Seventeenth* Day of *April 1979*

[SEAL]

*Attest:*

RUTH C. MASON
*Attesting Officer*

DONALD W. BANNER
*Commissioner of Patents and Trademarks*